US008221141B2

(12) United States Patent
Lee et al.

(10) Patent No.: US 8,221,141 B2
(45) Date of Patent: Jul. 17, 2012

(54) ELECTRICAL CONNECTOR

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 44 days.

(21) Appl. No.: 12/820,508

(22) Filed: Jun. 22, 2010

(65) Prior Publication Data

US 2011/0281467 A1 Nov. 17, 2011

(30) Foreign Application Priority Data

May 14, 2010 (TW) ..... 99209026 U

(51) Int. Cl.
*H01R 13/62* (2006.01)

(52) U.S. Cl. ..... 439/157

(58) Field of Classification Search ..... 439/157, 439/159, 459, 267
See application file for complete search history.

(56) References Cited

U.S. PATENT DOCUMENTS 5,975,917 A * 11/1999 Wang et al. ..... 439/79
6,132,241 A * 10/2000 Hwang ..... 439/459
6,997,728 B1 * 2/2006 Chen ..... 439/260
7,338,303 B1 * 3/2008 Yi et al. ..... 439/267
7,442,063 B2 * 10/2008 Sabo et al. ..... 439/267

* cited by examiner

*Primary Examiner* — Truc Nguyen
(74) *Attorney, Agent, or Firm* — Rosenberg, Klein & Lee

(57) ABSTRACT

An electrical connector includes an insulated seat, and first and second seats. A plurality of first and second terminals are embedded partially into the first and second seats via insert molding process in such a manner that when the first and second seats are assembled to the insulated seat, a first engagement structure of the first seat engages with a second engagement structure of the second seat while one of the two clamping structures at the insulated seat clamps an assembly of the first and second assembling structures of the first and second seats.

6 Claims, 7 Drawing Sheets

ELECTRICAL CONNECTOR

This application claims the benefits of the Taiwan Patent Application Serial NO. 099209026, filed on May 14, 2010, the subject matter of which is incorporated herein by reference.

BACKGROUND OF THE INVENTION

1. Field of the Invention

The present invention relates to an electrical connector, more particularly to an electrical connector that includes an insulated seat, and first and second seats for holding the signal terminals thereon and the assembly of first and second seats can be coupled to the insulated seat with ease.

2. Description of the Prior Art

FIG. 1 is a perspective view of a conventional electrical connector 1, which includes an insulated body 11 and a plurality of signal terminals 12. The insulated body 11 has a reception channel 111 and a plurality of terminal slots 112 in spatial communication with the reception channel 111. The insulated body 11 is constructed from a high-heat resistant insulated material and the signal terminals 12 are inserted respectively through the terminal slots 112 in the insulated body 11.

It is noted that during the assembly and prior to inserting the signal terminals 12 through the slots 112 in the insulated body 11, the terminals 12 must be held aligned with one another and the terminals 12 are later inserted through the slots 112 in alignment. Non-alignment of the terminals within the slots 112 will result in poor quality of the conventional electrical connector 1 and leading to discarding thereof, which, in turn, causes extra manufacturing expense for the manufacturers.

After assembly, the terminals 12 are partially exposed from the slots 112 in the insulated body 21 in such a manner that during the transport of the conventional electrical connectors from one place to the other, the conventional electrical connectors may tangle with one another and thus the terminals 12 may be pulled out from the insulated body 21 due to accidentally engaging, thereby resulting in damage. In addition, exposure of the terminals 12 to an exterior of the insulated body 21 tends to oxidation of the terminals 12, thereby lowering the transmission quality thereof.

In addition, since the conventional electrical connector 1 is used in a computer set (in the CPU) under high temperature and hence may lead to damage after a relatively long period of use. Since the insulated body 11 is integrally molded as a one-piece structure, the whole assembly needs to be discarded even in case of minor damage due to difficulty in replacing the minor part, thereby causing environmental pollution.

SUMMARY OF THE INVENTION

In the prior art technique, the signal terminals are hard to be arranged in alignment after the assembly such that the signal terminals are undesirably pulled out due to relative collision during transport of the conventional electrical connectors. The signal terminals are subjected to oxidation due to being pulled out fro the insulated body, hence resulting in extra manufacturing expense for the manufacturers. The insulated body tends to damage under high temperature environment. The entire assembly must be discarded since minor damage cannot be replaced.

The object of the present invention is to provide an electrical connector that includes first and second seats interactively engaged with each other, the assembly of which is later inserted into an insulated seat body. Since the former three elements are assembled piece by piece, in case of minor damage, only the damaged part is required to be replaced with new ones, thereby causing lesser burden to the consumer using the electrical connector of the present invention.

The other object of the present invention is to provide an electrical connector including a plurality of first and second terminals which are embedded partially into the first and second seats via the insert molding process such that the first and second terminals are disposed in alignment and that the terminals can not be easily and undesirably pulled out, thereby preventing occurrence of oxidation to the terminals and prolonging the service life of the electrical connector of the present invention. In addition, since the first and second terminals are elongated and thin in dimension, several pieces of semi-finished first and second terminals can be punched out from the thin-and-elongated metal plates. There will be little waste resulted after fabrication of the first and second terminals.

The electrical connector of the present invention is intended for mounting uprightly onto a printed circuit board in order to receive a mating module, and includes an insulated seat, two clamping elements, a first seat and a second seat.

The insulated seat includes an insulated seat body having an upper side formed with an insert channel therein, and two clamping structures.

The clamping structures are respectively attached to two opposite sides of the insulated seat body.

The clamping elements are installed respectively to two opposite sides of the insulated seat for clamping two opposite ends of the mating module.

The first seat includes a first seat body, a plurality of first terminals, a first engagement structure and a first assembling structure. The first terminals are embedded partially into the first seat body via insert molding process. The first engagement structure is attached to one side of the first seat body. The first assembling structure is attached to the other side of the first seat body.

The second seat includes a second seat body, a plurality of second terminals, a second engagement structure and a second assembling structure. The second terminals are embedded partially into the second seat body via insert molding process. The second engagement structure is attached to one side of the second seat body and corresponding to the first engagement structure. The second assembling structure is attached to the other side of the second seat body and corresponding to the first assembling structure.

When the first and second seats are assembled to the insulated seat, the first engagement structure of the first seat engages with the second engagement structure of the second seat while one of the two clamping structures clamps an assembly of the first and second assembling structures of the first and second seats.

In the conventional electrical connector, the signal terminals within the insulated body are not always in alignment due to failure of enable to hold the terminals in alignment during the assembly operation. Thus, the signal terminals are easily and undesirably pulled out from the insulated body, thereby leading to ruin and oxidation of the terminals and resulting in discarding of the conventional electrical connector, hence causing extra manufacturing expense for the manufacturers. Moreover, the insulated body is generally molded as one-piece structure and in case of minor damage; the minor damage can not be repaired and thus leading to discarding of the entire electrical connector and causes environmental pollution.

In the electrical connector of the present invention, first of all, the first and second terminals are partially embedded within the first and second seat bodies via the insert molding process, the first and second terminals are disposed in alignment with one another prior to inserting the same into the insulated seat body. Thus after assembly, the first and second terminals are disposed in alignment relative to one another and can not be pulled out from the insulated seat body with ease, hence providing a longer service life. In addition, since the first and second terminals are elongated and thin in dimension, several pieces of semi-finished first and second terminals can be punched out from the thin-and-elongated metal plates. There will be little waste resulted after fabrication of the first and second terminals. Moreover, the first and second seat are interactively engaged with each other prior to inserting the same into the insulated seat body, in case of a partial damage, only the damaged part is required to be replaced with new ones, thereby economizing the purchase expense for the consumer using the electrical connector of the present invention.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
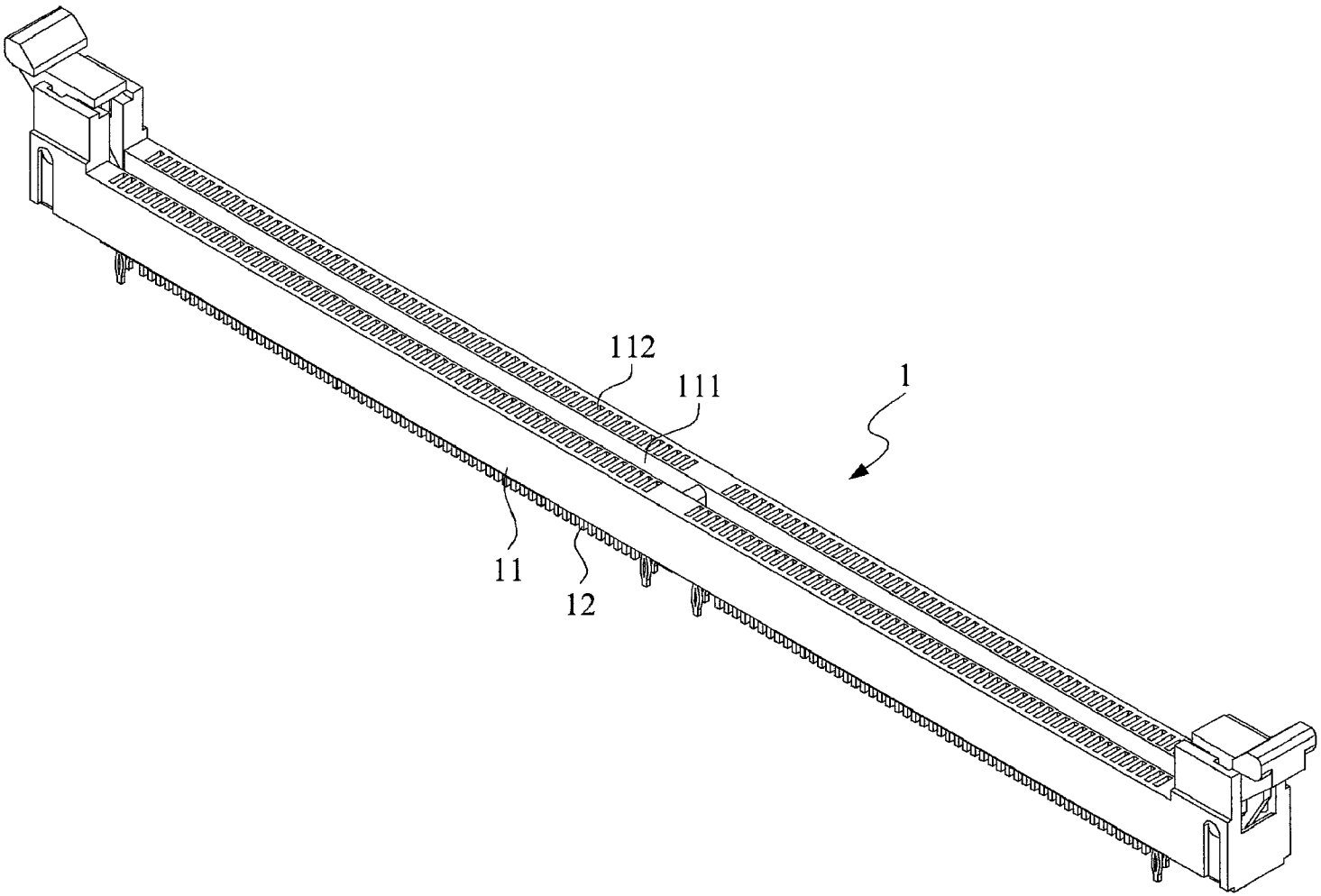
FIG.1(Prior Art)
FIG. 1 is a perspective view of a conventional electrical connector.
Figure 2A:
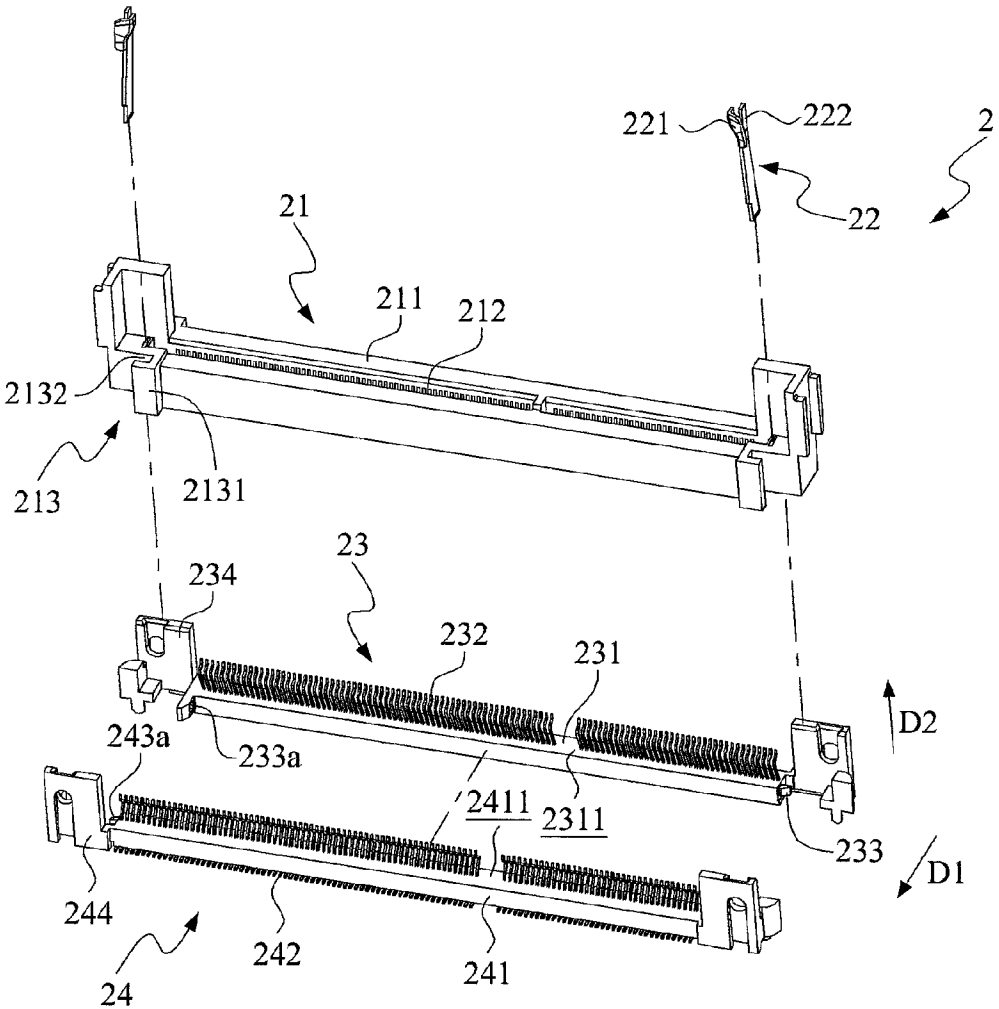
FIGS. 2A and 2B respectively illustrate an exploded and perspective views of the first embodiment of an electrical connector of the present invention, wherein the elements in FIG. 2B are turned upside down to illustrates the bottom view thereof.
Figure 2B:
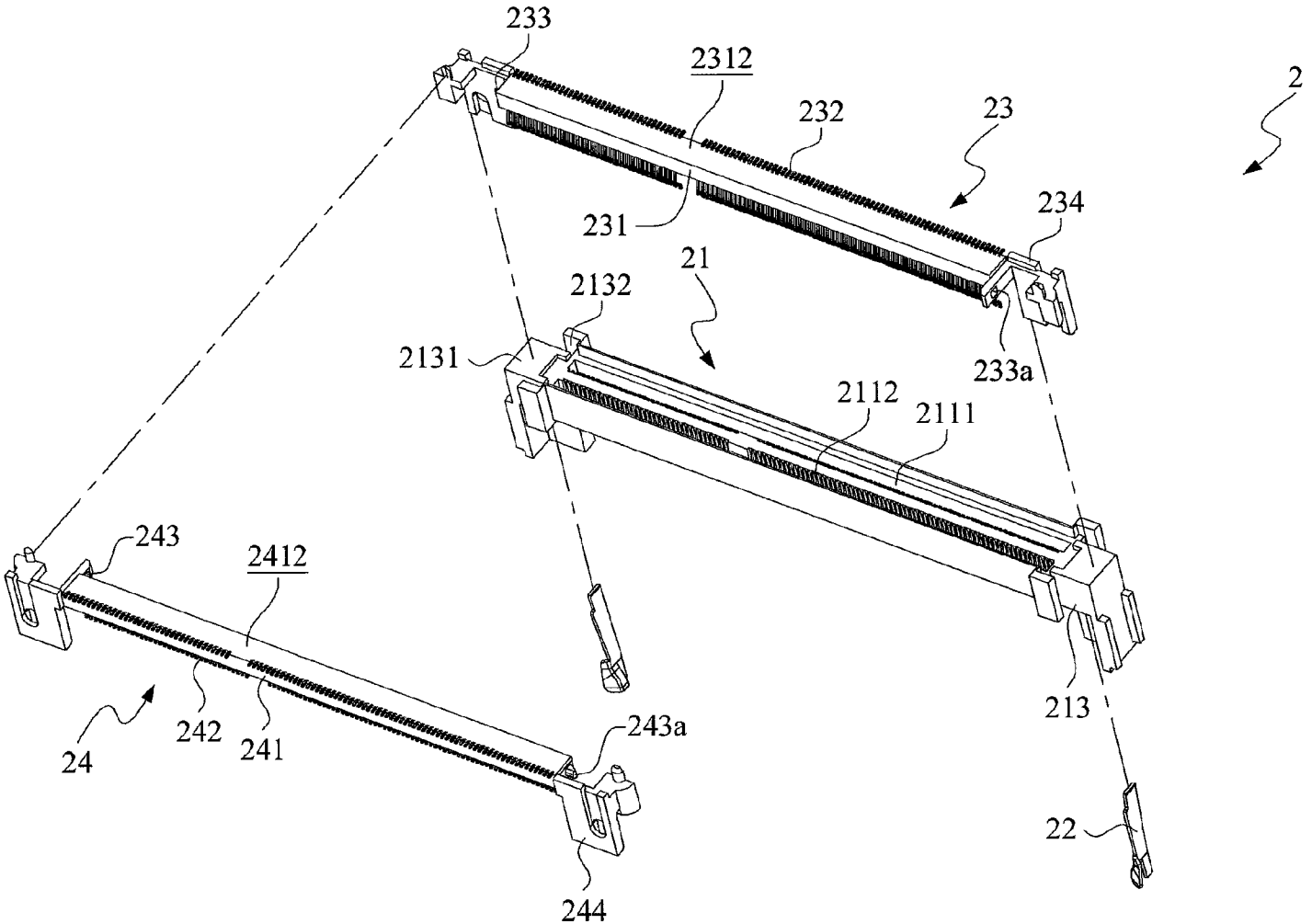

Referring to FIGS. 2A and 2B, wherein FIG. 2A illustrates an exploded and perspective view of the first embodiment of an electrical connector of the present invention and the elements in FIG. 2B are turned upside down to illustrates the bottom view thereof. As shown, the electrical connector 2 of the present invention is intended to be mounted uprightly onto a printed circuit board (not shown) in order to receive a mating module (not shown), and includes an insulated seat 21, two clamping elements 22, a first seat 23 and a second seat 24.

The insulated seat 21 includes an insulated seat body 211 and several pieces of clamping structures 213. The insulated seat 21 is made from plastic materials. The insulated seat body 211 has an upper side formed with an insert channel 212 therein for receiving the mating module (not shown). The insulated seat body 211 further has a bottom side formed with two terminal channels 2111, each of which is further provided with a plurality of passages 2112 such that each terminal channel 2111 in the bottom side is in spatial communication with the insert channel 212 in the upper side via the passages 2112.

The two clamping structures 213 are attached respectively to two opposite ends of the insulated seat body 211. Each clamping structure 213 includes a clamping block 2131 and a clamping recess 2132, wherein the clamping blocks 2131 extends upwardly and respectively from two opposite ends of the insulated seat body 211 and cooperate with two opposite ends of the insulated seat body 211 to define the clamping recesses 2132.

The two clamping elements 22 are installed (such as inserted) respectively to two opposite sides of the insulated seat 21 for clamping two opposite ends of the mating module once the later is inserted into the insert channel 212 of the insulated seat body 211. Each clamping element 22 has a clamping portion 222 and a contact portion 221 that is inclined outwardly with respect to the clamping portion 222 for guiding the mating module toward the clamping portion 222, hence into the insert channel 212 in the upper side of the insulated seat body 211.

The first seat 23 includes a first seat body 231, a plurality of first terminals 232, a first engagement structure 233, a third engagement structure 233*a* and a first assembling structure 234. The first seat 23 is preferably made from high-heat resistant and plastic material. The first seat body 231 has an assembly upper side 2311 and an installing lower side 2312.

Figure 3A:
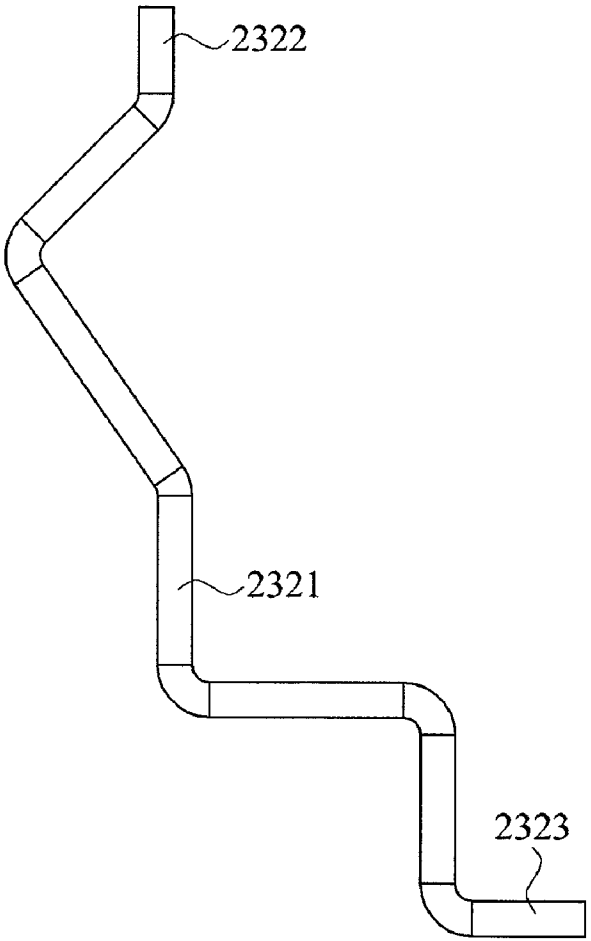
FIG. 3A shows a schematic view of a first terminal employed in the electrical connector of the present invention.

FIG. 3A shows a schematic view of a first terminal 232 employed in the electrical connector of the present invention. Also referring to FIGS. 2A and 2B, each of the first terminals 232 has an insert section 2321 embedded into the first seat body 231 via insert molding process, a contact section 2322 projecting integrally from one end of the insert section 2321 through the upper and lower sides 2311, 2312 and extending into the insert channel 212 of the insulated seat body 211 and an installing section 2323 projecting integrally from the other end of the insert section 2321 for fixing onto the printed circuit board (not shown). As seen in FIG. 3A, each of the first terminals 232 are elongated and thin in dimension, several pieces can be arranged in parallel manner prior to be punched out from thin-and-elongated metal plates. There will be little waste resulted after fabrication of the first terminals 232.

The first engagement structure 233 is attached to and extends outwardly and axially from one side of the first seat body 231 while the third engagement structure 233*a* is attached to the other side of said first seat body 231. The first engagement structure 233 is an engaging block while the third engagement structure 233*a* is an engaging recess.

The first assembling structure 234 is attached and extends outwardly and axially from to the other side of the first seat body 231 in alignment with one of the clamping elements 213. The first assembling structure 234 includes an assembling block after assembly is received between the clamping block 2131 and the clamping recess 2132 of the respective clamping structure 213.

The second seat 24 includes a second seat body 241, a plurality of second terminals 242, a second engagement structure 243, a fourth engagement structure 243*a* and a second assembling structure 244. The second seat 24 is preferably made from high-heat resistant and plastic material, and has an assembly upper side 2411 and an installing lower side 2412.

Figure 3B:
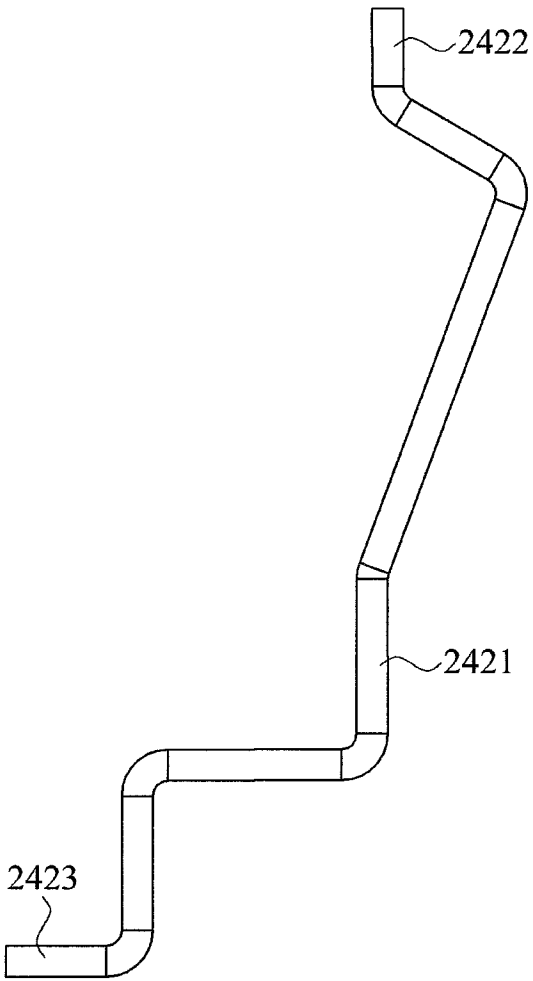
FIG. 3B shows a schematic view of a second terminal employed in the electrical connector of the present invention.

FIG. 3B shows a schematic view of a second terminal 242 employed in the electrical connector of the present invention. Also referring to FIGS. 2A and 2B, each of the second terminals 242 has an insert section 2421 embedded into the second seat body 242 via insert molding process, a contact section 2422 projecting integrally from one end of the insert section 2421 through the upper and lower sides 2411, 2412 and extending into the insert channel 212 of the insulated seat body 211 for contacting the mating module, and an installing section 2423 projecting integrally from the other end of the insert section 2421 for fixing onto the printed circuit board (not shown). As seen in FIG. 3B, each of the second terminals 242 are elongated and thin in dimension, several pieces can be punched out in parallel manner from a thin-and-elongated metal plate prior to be bent out. There will be little waste resulted after fabrication of the second terminals 242.

The second engagement structure 243 is attached to one side of the second seat body 241 and corresponding to the first engagement structure 233. The fourth engagement structure 243*a* is attached to the other side of the second seat body 241. The second engagement structure 243 includes an engaging recess while the fourth engagement structure 243*a* includes an engaging block.

The second assembling structure 244 is attached to and extends outwardly and axially from the other side of the second seat body 241 adjacent to the fourth engagement structure 243*a* and corresponding to the first assembling structure 234 and one of the clamping structures 213 in such a manner that when the first and second seats 23, 24 are assembled to the insulated seat 21, the first engagement structure 233 of the first seat 23 engages with the second engagement structure 243 of the second seat 24, the third and fourth engagement structures 233*a*, 243*a* are fastened relative to each other while one of the two clamping structures 213 clamps an assembly of the first and second assembling structures 234, 244 of the first and second seats 23, 24.

Referring again to FIG. 2A, for assembly of the electrical connector 2 of the present invention, the first and second seats 23, 24 are brought toward each other along the direction D1 so that the first engagement structure 233 of the first seat 23 engages with the second engagement structure 243 of the second seat 24 while the third and fourth engagement structures 233*a*, 243*a* are fastened relative to each other, thereby coupling the first and second seats 23, 24. After which, the assembly of the first and second seats 23, 24 are inserted along the direction D2 toward the insulated seat 211, where one of the two clamping structures 213 clamps an assembly of the first and second assembling structures 234, 244 of the first and second seats 23, 24.

Figure 4A:
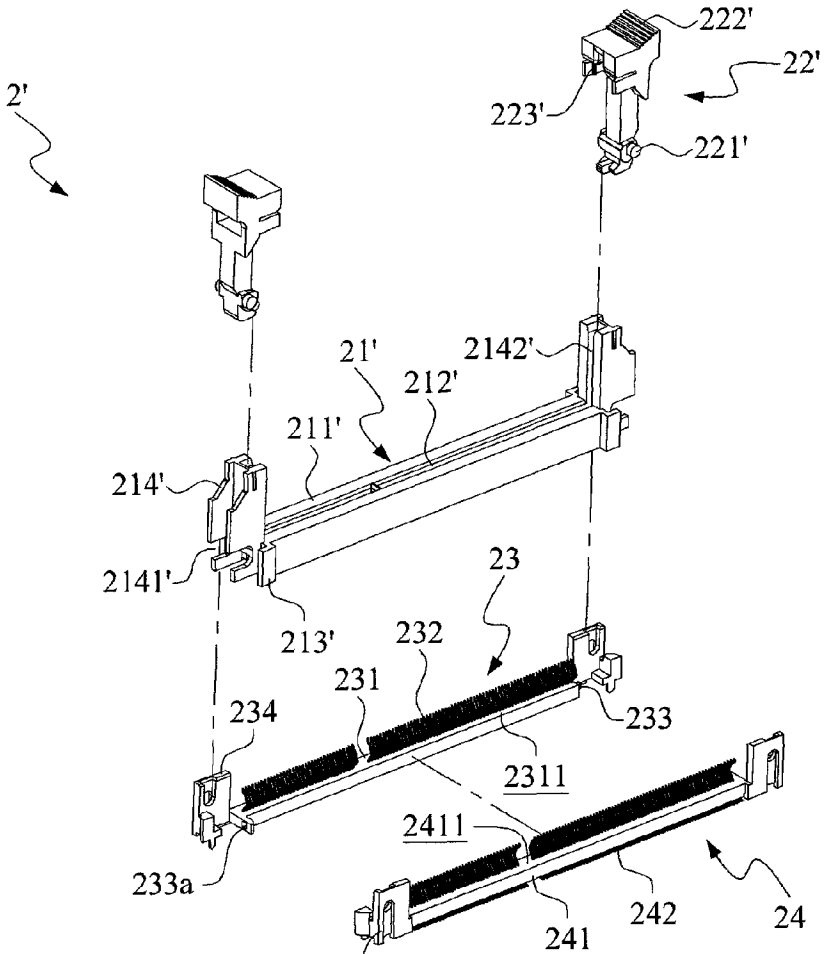
FIGS. 4A and 4B respectively illustrate an exploded and perspective views of the second embodiment of the electrical connector of the present invention, wherein the elements in FIG. 4B are turned upside down to illustrates the bottom view thereof.
Figure 4B:
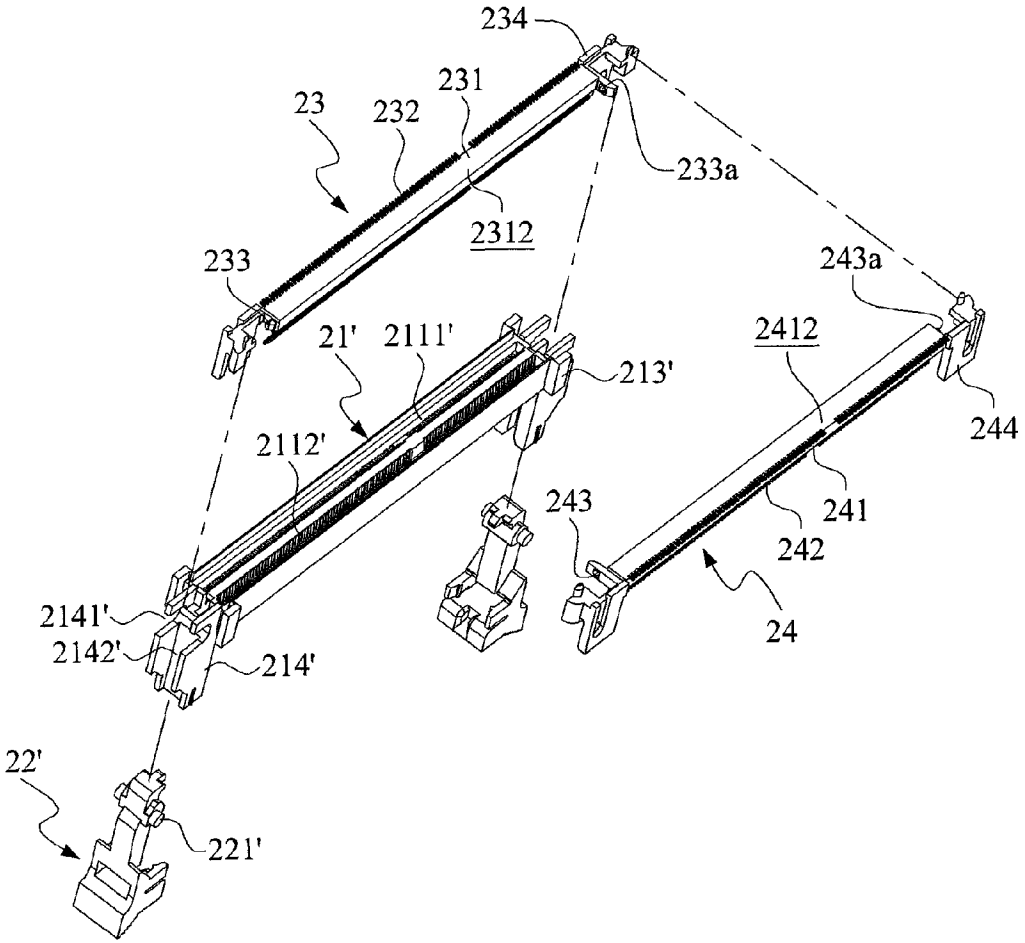

Referring to FIGS. 4A and 4B, wherein FIG. 4A illustrates an exploded and perspective view of the second embodiment of the electrical connector 2' of the present invention, while the elements in FIG. 4B are turned upside down to illustrates the bottom view thereof. The electrical connector 2' accordingly includes an insulated seat 21', two clamping elements 22', a first seat 23' and a second seat 24'.

The second embodiment is similar to the previous embodiment in structure except in the insulated seat 21' and the clamping elements 22'. The insulated seat 21' of the second embodiment further includes two limiting members 214' attached respectively to two opposite sides of the insulated seat body 211' for restricting the position of the clamping elements 22' so as to prevent wobbling of the clamping elements 22' relative to the insulated seat body 211", thereby preventing untimely disengagement of the clamping elements 22' from the insulated seat body 21'. Each limiting member 214' has a retention groove 2141' at an exterior thereof and a guide slide rail 2142' on an interior thereof for guiding the mating module into the insert channel 212' in the insulated seat body 21' during insertion of the mating module into the electrical connector 2' of the present invention.

The clamping element 22' extend through the retention grooves 2141' in the limiting members 214', and have pivot blocks 221' connected pivotally to the first and second seats 23, 24, two pressing portions 222' exposed from two sides of the insulated seat body 21' for applying external force thereon during removal of the mating module from the insulated seat body 211' and clamping portions 223' inboard to the pressing portion 222' for clamping two opposite ends of the mating module once the latter is inserted into the insert channel 212' of the insulated seat body 211'. The clamping elements 22' are preferably made from plastic material.

Note that the insulated seat body 211' may be provided with pivot holes at two opposite sides thereof and the pivot holes are formed in the walls defining the retention grooves 2141' in the limiting members 214' such that the pivot blocks 221' of the clamping elements 22' can be inserted into the pivot holes for mounting the clamping elements 22 relative to the insulated seat body 211'.

In the conventional electrical connector, the signal terminals within the insulated body are not always in alignment due to failure of enabling to hold the terminals in alignment during the assembly operation. Thus, the signal terminals are easily and undesirably pulled out from the insulated body due to relative collision during the transport thereof, thereby leading to ruin and damage of the conventional electrical connector, hence causing extra manufacturing expense for the manufacturers. Moreover, the insulated body is generally molded as one-piece structure and in case of minor damage; the minor damage can not be repaired and thus leading to discarding of the conventional electrical connector and causes environmental pollution.

In the electrical connector of the present invention, first of all, the first and second terminals 232, 242 are partially embedded within the first and second seat bodies 231, 241 via the insert molding process, the first and second terminals 232, 242 are disposed in alignment with one another prior to inserting the same into the insulated seat body 211. Thus after assembly, the first and second terminals 232, 242 are disposed in alignment relative to one another and can not be pulled out with ease, hence providing a longer service life. In addition, since the first and second terminals 232, 242 are elongated and thin in dimension, several pieces of semi-finished first and second terminals can be punched out from the thin-and-elongated metal plates. There will be little waste resulted after fabrication of the first and second terminals 232, 242. Moreover, the first and second seat 23, 24 are interactively engaged with each other prior to inserting the same into the insulated seat body 211, in case of a partial damage, only the damaged part is required to be replaced with new ones, thereby economizing the purchase expense for the consumer using the electrical connector of the present invention.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector for mounting uprightly onto a printed circuit board in order to receive a mating module, the electrical connector comprising:

an insulated seat including an insulated seat body having an upper side formed with an insert channel therein, and two clamping structures attached to said insulated seat body;

two clamping elements installed respectively to two opposite sides of said insulated seat for clamping two opposite ends of the mating module;

a first seat including:

a first seat body, a plurality of first terminals embedded partially into said first seat body via insert molding process, a first engagement structure attached to one side of said first seat body, and a first assembling structure attached to the other side of said first seat body;

a second seat including:

a second seat body, a plurality of second terminals embedded partially into said second seat body via insert molding process, a second engagement structure protrudingly attached to one longitudinal end side of said second seat body and corresponding to said first engagement structure, said second engagement structure operable to releasably capture said first engagement structure, and a second assembling structure attached to the other side of said second seat body and corresponding to said first assembling structure;

wherein, when said first and second seats are assembled to said insulated seat, said first engagement structure of said first seat releasably engages with said second engagement structure of said second seat while one of said two clamping structures clamps an assembly of said first and second assembling structures of said first and second seats.

2. The electrical connector according to claim 1, wherein said first engagement structure includes an engaging block and said second engagement structure includes an engaging recess for receiving said engaging block therein.

3. The electrical connector according to claim 2, wherein said first seat further includes a third engagement structure attached to the other side of said first seat body adjacent to said first assembling structure, said second seat further including a fourth engagement structure attached to the other side of said second seat body adjacent to said second assembling structure, said third engagement structure including an engaging recess and said fourth engagement structure including an engaging block for extending and engaging within said engaging recess of said third engagement structure.

4. The electrical connector according to claim 3, wherein said two clamping elements are inserted detachably into said two opposite sides of said insulated seat for clamping two opposite ends of the mating module.

5. The electrical connector according to claim 1, wherein said two clamping elements are attached pivotally to said first and second seat.

6. The electrical connector according to claim 1, wherein said two clamping elements are attached pivotally to two opposite ends of said insulated seat.

* * * * *